US009276366B1

(12) United States Patent
Flores

(10) Patent No.: US 9,276,366 B1
(45) Date of Patent: Mar. 1, 2016

(54) ELECTRICAL CONNECTION DEVICE

(71) Applicant: Ernesto Flores, Pico Rivera, CA (US)

(72) Inventor: Ernesto Flores, Pico Rivera, CA (US)

( * ) Notice: Subject to any disclaimer, the term of this patent is extended or adjusted under 35 U.S.C. 154(b) by 155 days.

(21) Appl. No.: 14/010,615

(22) Filed: Aug. 27, 2013

(51) Int. Cl.
*H01R 13/66* (2006.01)
*H01R 24/76* (2011.01)
*H01R 24/66* (2011.01)

(52) U.S. Cl.
CPC ..... *H01R 24/76* (2013.01); *H01R 24/66* (2013.01)

(58) Field of Classification Search
CPC ..... H01R 24/66; H01R 24/68; H01R 24/76; H01R 24/78
USPC ..... 439/535, 536, 638, 639, 650, 651
See application file for complete search history.

(56) References Cited

U.S. PATENT DOCUMENTS

| | | | | |
|---|---|---|---|---|
| 6,179,665 | B1 * | 1/2001 | Rossman et al. | 439/654 |
| 6,211,581 | B1 * | 4/2001 | Farrant | 307/117 |
| D594,817 | S | 6/2009 | Abdallah et al. | |
| 7,638,971 | B2 | 12/2009 | Guccione et al. | |
| 8,107,243 | B2 | 1/2012 | Guccione et al. | |
| 8,994,330 | B2 * | 3/2015 | Kuo et al. | 320/111 |
| 2008/0007212 | A1 | 1/2008 | Theytaz et al. | |
| 2008/0012423 | A1 * | 1/2008 | Mimran | 307/11 |
| 2008/0265836 | A1 | 10/2008 | Inoue et al. | |
| 2009/0267562 | A1 | 10/2009 | Guccione et al. | |

* cited by examiner

*Primary Examiner* — Khiem Nguyen

(57) ABSTRACT

An electrical connection device provides multiple types of sockets for facilitating charging of multiple electronic devices. The device includes a housing having a front face, a rear face, and a perimeter wall extending around and between the front face and the rear face to define an interior space of the housing. An electrical plug is coupled to the housing and configured for insertion into an electrical socket. A plurality of electrical outlets is coupled to the housing. Each electrical outlet is electrically coupled to the electrical plug. A plurality of ports is also coupled to the housing. Each port is electrically coupled to the electrical plug.

8 Claims, 4 Drawing Sheets

ELECTRICAL CONNECTION DEVICE

FIELD OF THE DISCLOSURE

The disclosure relates to electrical connection devices and more particularly pertains to a new electrical connection device for providing multiple types of sockets for facilitating charging of multiple electronic devices.

SUMMARY OF THE DISCLOSURE

An embodiment of the disclosure meets the needs presented above by generally comprising a housing having a front face, a rear face, and a perimeter wall extending around and between the front face and the rear face to define an interior space of the housing. An electrical plug is coupled to the housing and configured for insertion into an electrical socket. A plurality of electrical outlets is coupled to the housing. Each electrical outlet is electrically coupled to the electrical plug. A plurality of ports is also coupled to the housing. Each port is electrically coupled to the electrical plug.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
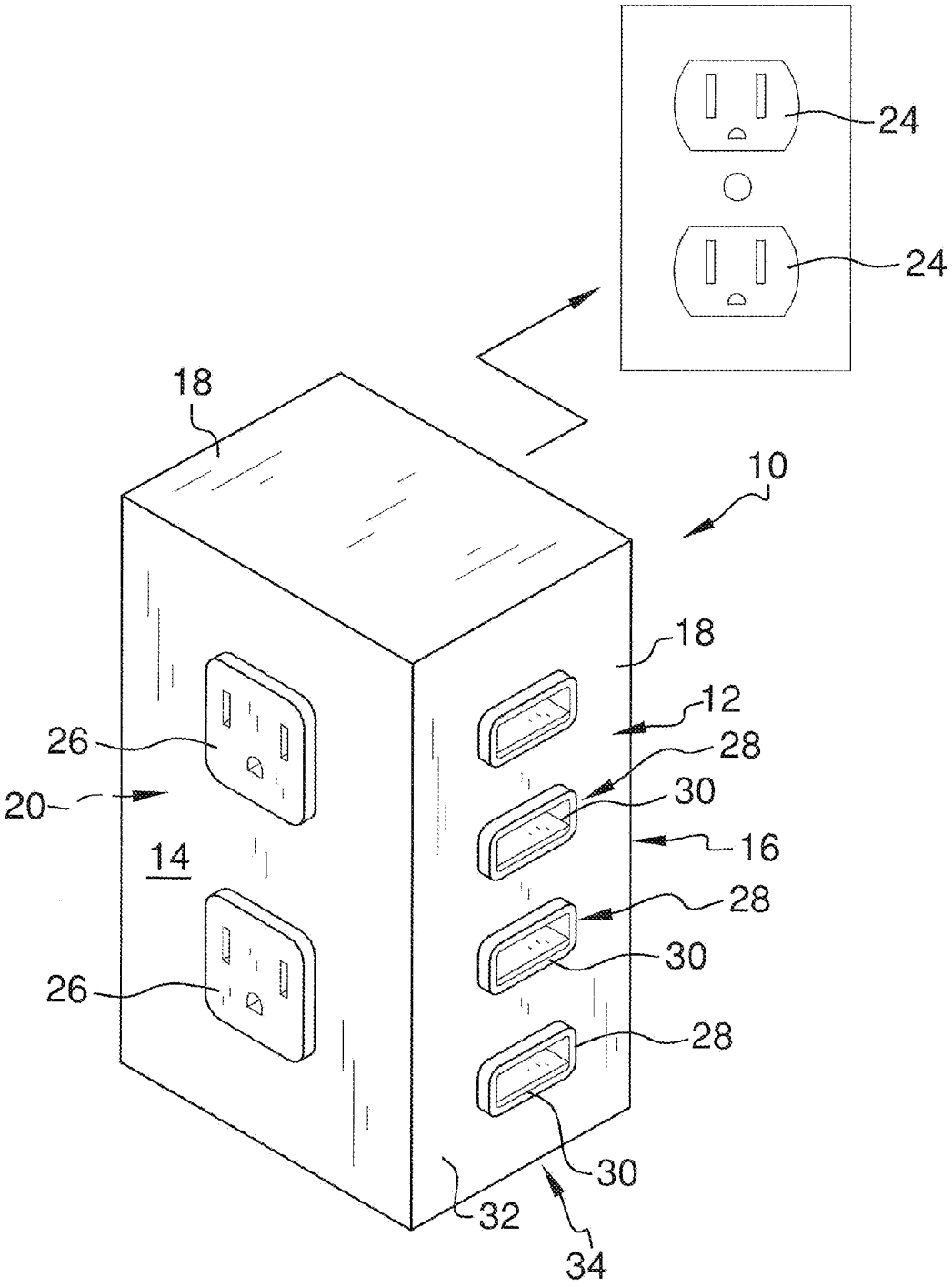
FIG. 1 is a top front side perspective view of a electrical connection device according to an embodiment of the disclosure.

With reference now to the drawings, and in particular to FIGS. 1 through 4 thereof, a new electrical connection device embodying the principles and concepts of an embodiment of the disclosure and generally designated by the reference numeral 10 will be described.

Figure 2:
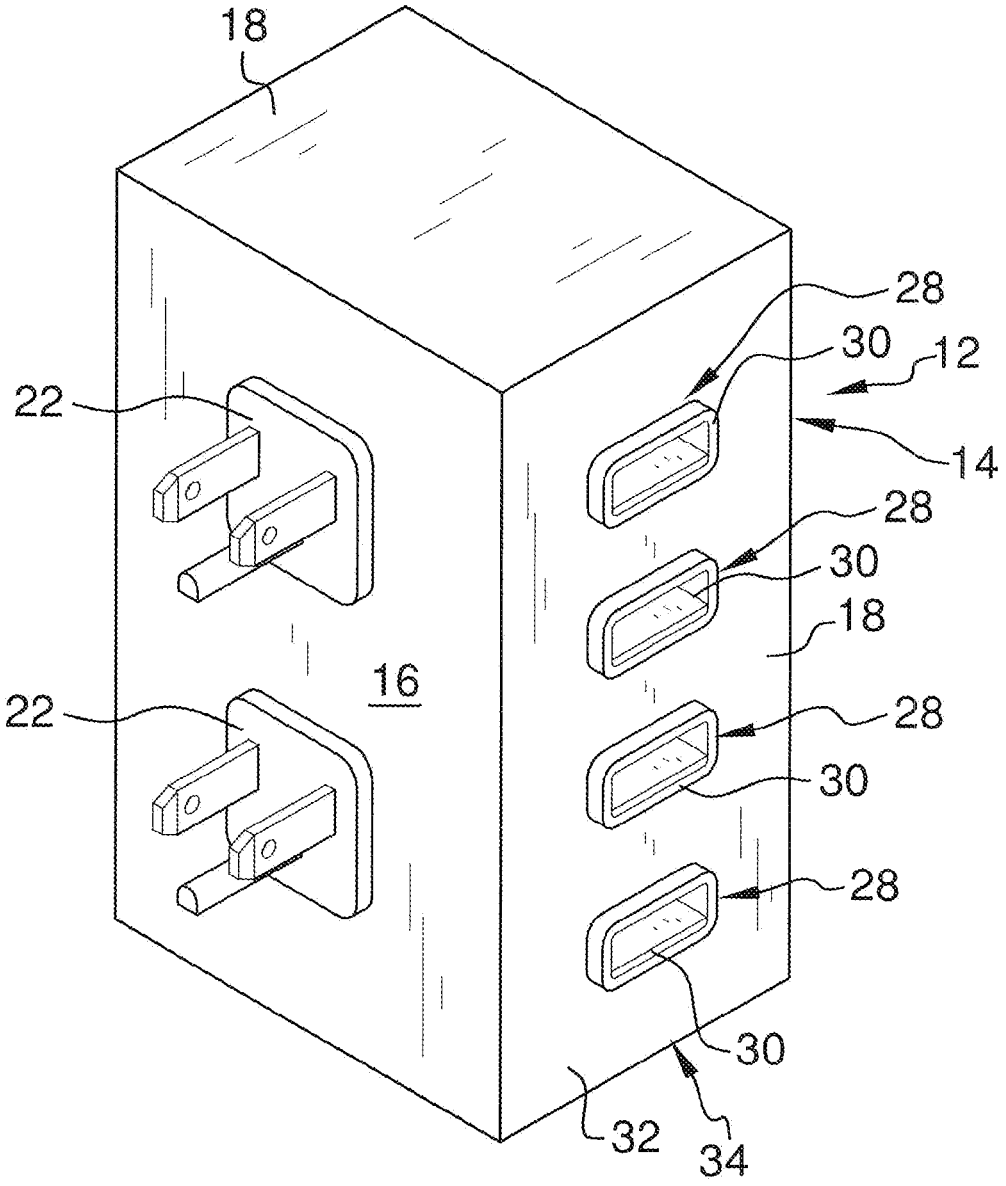
FIG. 2 is a top back side perspective view of an embodiment of the disclosure.
Figure 3:
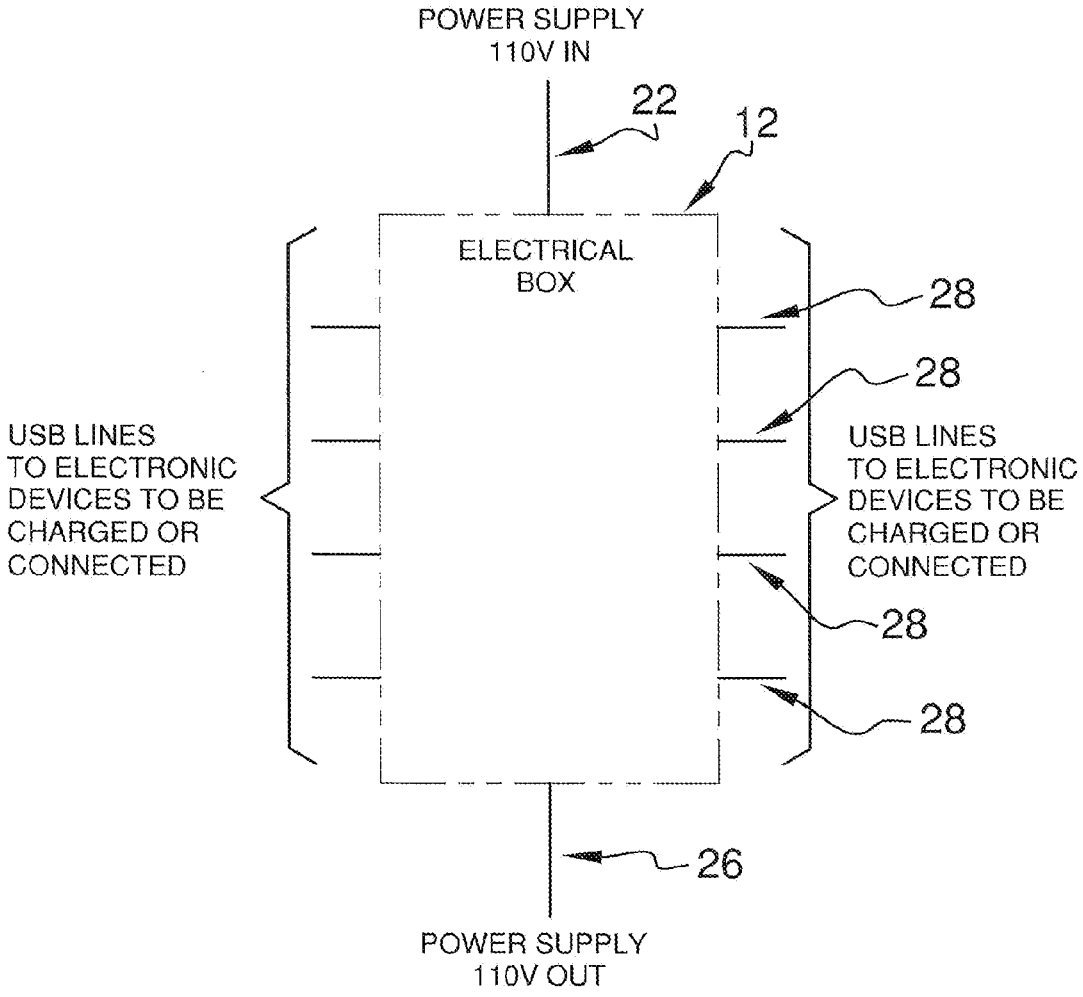
FIG. 3 is a schematic view of an embodiment of the disclosure.

As best illustrated in FIGS. 1 and 2, the electrical connection device 10 generally comprises a housing 12 having a front face 14, a rear face 16, and a perimeter wall 18 extending around and between the front face 14 and the rear face 16 to define an interior space 20 of the housing 12. An electrical plug 22 is coupled to the housing 12. The electrical plug 22 is configured for insertion into an electrical socket 24 of conventional design. The electrical plug 22 may be coupled to and extend from the rear face 16 of the housing 12. The electrical plug 22 may further be one of a pair of electrical plugs 22 coupled to and extending from the housing 12 as described. The electrical plugs 22 are aligned on the rear face 16 of the housing 12 wherein the electrical plugs 22 are configured for engaging a conventional vertically aligned pair of electrical sockets 24. A plurality of electrical outlets 26 is coupled to the housing 12. Each electrical outlet 26 is electrically coupled to at least one of the electrical plugs 22. The electrical outlets 26 may be positioned on and extending through the front face 14 of the housing 12. Each of a plurality of ports 28 is also coupled to the housing 12 to facilitate charging of devices such as smartphones, computer tablets, and the like. Each port 28 is electrically coupled to at least one of the electrical plugs 22. Each port 28 more may particularly be a universal serial bus port 30. Each port 28 is positioned on and extends through an associated lateral side 32 of the perimeter wall 18. The ports 28 may be arranged into a pair of columns 34. Each column 34 is positioned on an associated lateral side 32 of the perimeter wall 18 of the housing 12.

Figure 4:
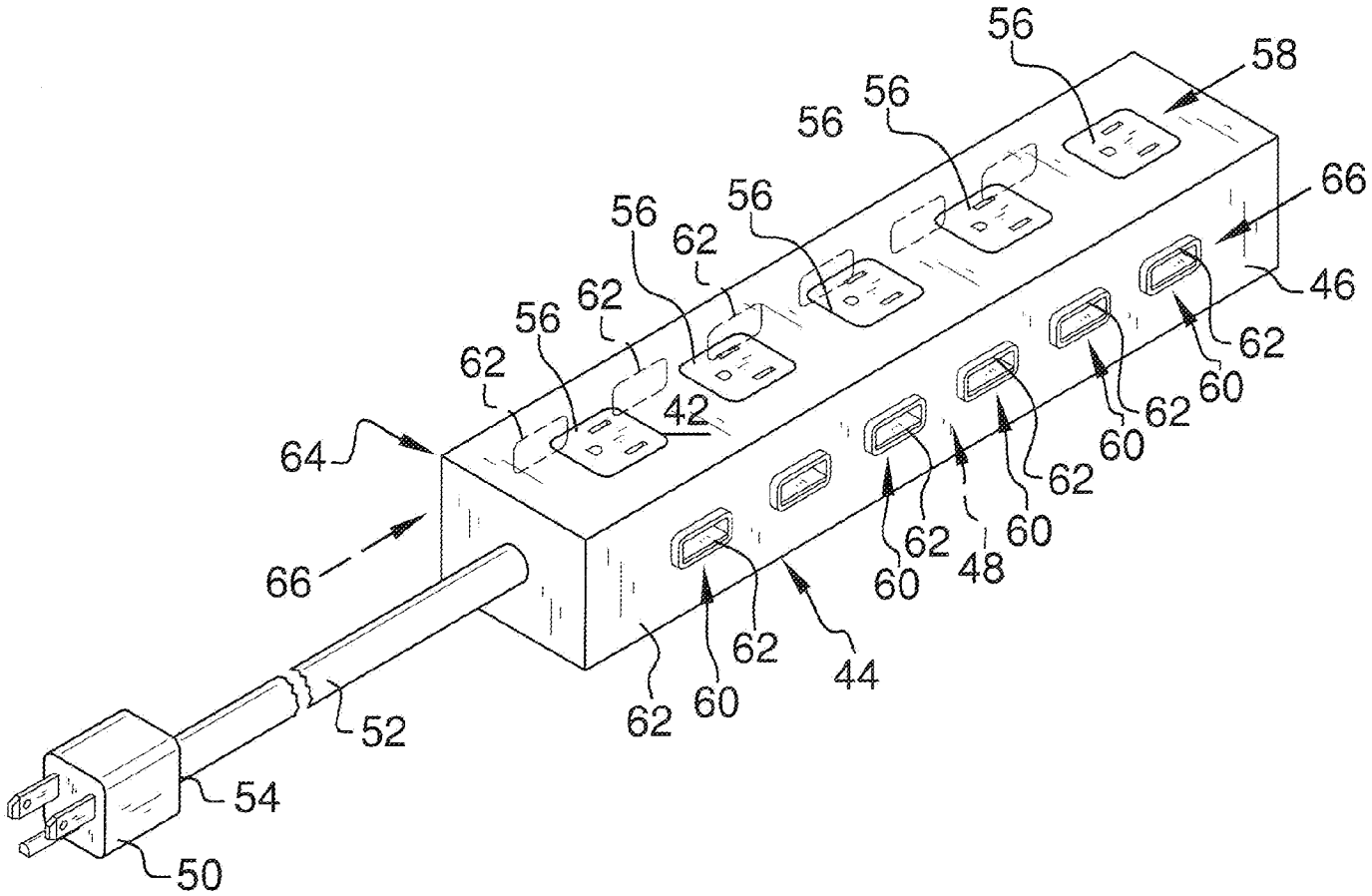
FIG. 4 is a top front side perspective view of an alternative embodiment of the disclosure.

In an embodiment shown more particularly in FIG. 4, a housing 40 has a top face 42, a bottom face 44, and a perimeter wall 46 extending around and between the top face 42 and the bottom face 44 to define an interior space 48 of the housing 40. An electrical plug 50 is coupled to the housing 40. The electrical plug 50 is configured for insertion into an electrical socket 24 of conventional design. A cord 52 is coupled to and extends from the housing 40. The electrical plug 50 is coupled to a distal end 54 of the cord 52 relative to the housing 40. A plurality of electrical outlets 56 is coupled to the housing 40. Each electrical outlet 56 is electrically coupled to the electrical plug 50. The electrical outlets 56 may be arranged into a row 58 of outlets 56 positioned on and extending through the top face 42 of the housing 40. Each of a plurality of ports 60 is coupled to the housing 40. Each port 60 is electrically coupled to the electrical plug 50. Each port 60 may again be a universal serial bus port 62. Each port 60 may be positioned on and extend through an associated side face 64 of the housing 40. The ports 60 may be arranged into a pair of rows 66. Each row 66 is positioned on an associated side face 64 of the housing 40.

In use, each electrical outlet 26,56 is electrically coupled to an electrical plug 22,50 to provide power to each outlet 26,56 as needed. Electronic devices may be connected to the outlets 26,56 as desired in conventional fashion. Additionally, each port 28,60 is also electrically coupled to a respective plug 22,50 to provide electrical current to each port 28,60. Thus, electronic devices may be directly plugged into a selectable port 28,60 to charge or provide electric power directly to a desired device.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An electrical connection device comprising:

a housing having a front face, a rear face, and a perimeter wall extending around and between said front face and said rear face to define an interior space of said housing;

a pair of electrical plugs coupled to said housing, said pair of electrical plugs being vertically aligned wherein said pair of electrical plugs is configured for insertion into a vertically aligned pair of electrical sockets;

a plurality of electrical outlets coupled to said housing, each said electrical outlet being electrically coupled to both of said electrical plugs; and a plurality of ports coupled to said housing, each port being electrically coupled to both of said electrical plugs.

2. The device of claim 1, further comprising each said port being a universal serial bus port.

3. The device of claim 2, further comprising each said port being positioned on and extending through an associated lateral side of said perimeter wall.

4. The device of claim 1, further comprising said electrical outlets being positioned on and extending through said front face of said housing.

5. The device of claim 1, further comprising said electrical plug being coupled to and extending from said rear face of said housing.

6. The device of claim 1, further comprising a cord coupled to and extending from said housing, said electrical plug being coupled to a distal end of said cord relative to said housing.

7. The device of claim 1, further comprising said ports being arranged into a pair of columns, each column being positioned on an associated lateral side of said perimeter wall of said housing.

8. An electrical connection device comprising:

a housing having a front face, a rear face, and a perimeter wall extending around and between said front face and said rear face to define an interior space of said housing;

a pair of electrical plugs coupled to said housing, said pair of electrical plugs being vertically aligned wherein said pair of electrical plugs is configured for insertion into a vertically aligned pair of electrical sockets, each said electrical plug being coupled to and extending from said rear face of said housing;

a plurality of electrical outlets coupled to said housing, each said electrical outlet being electrically coupled to both of said electrical plugs, said electrical outlets being positioned on and extending through said front face of said housing; and a plurality of ports coupled to said housing, each port being electrically coupled to both of said electrical plugs, each said port being a universal serial bus port, each said port being positioned on and extending through an associated lateral side of said perimeter wall, said ports being arranged into a pair of columns, each column being positioned on an associated lateral side of said perimeter wall of said housing.

* * * * *